US005970874A

United States Patent [19]

Bill

[11] Patent Number: 5,970,874

[45] Date of Patent: Oct. 26, 1999

[54] MACHINE FOR FORMING IMPROVED GRAPHIC IMAGES ON SUBSTRATES

[76] Inventor: Ralph J. Bill, 15640 Graham St., Huntington Beach, Calif. 92649-1611

[21] Appl. No.: 09/105,075

[22] Filed: Jun. 26, 1998

[51] Int. Cl.[6] ..... B41L 35/14

[52] U.S. Cl. ..... 101/488; 101/115; 101/126

[58] Field of Search ..... 101/41, 487, 488, 101/115, 126, 129

[56] References Cited

U.S. PATENT DOCUMENTS

| | | | |
|---|---|---|---|
| D. 387,075 | 12/1997 | Farley . | |
| 3,996,088 | 12/1976 | Crouch . | |
| 4,152,193 | 5/1979 | Fitzwater . | |
| 4,287,826 | 9/1981 | Brabec . | |
| 4,671,174 | 6/1987 | Tartaglia et al. . | |
| 4,696,228 | 9/1987 | David et al. . | |
| 4,758,952 | 7/1988 | Harris, Jr. et al. | 101/487 |
| 4,898,484 | 2/1990 | Aoyagi et al. . | |
| 4,922,816 | 5/1990 | Neil | 101/41 |
| 4,963,208 | 10/1990 | Muncy et al. . | |
| 5,090,311 | 2/1992 | Brasa | 101/488 |
| 5,136,938 | 8/1992 | Pellegrina | 101/488 |
| 5,480,238 | 1/1996 | Nakano et al. . | |
| 5,553,951 | 9/1996 | Simpson et al. . | |
| 5,622,108 | 4/1997 | Benedetto et al. . | |
| 5,668,585 | 9/1997 | Brechko . | |
| 5,687,646 | 11/1997 | Sakaguchi . | |
| 5,690,439 | 11/1997 | Sasaki et al. . | |

*Primary Examiner*—Ren Yan
*Attorney, Agent, or Firm*—James G. O'Neill

[57] ABSTRACT

A process and system for applying or treating a graphic image on a substrate by using heat and pressure. The system is comprised of a frame having a plurality of supporting members and a reciprocally mounted heated platen extending from a first member, and a reciprocally mounted support having a pair of raised bars thereon reciprocally mounted on a second member. The heated platen and the raised bars of the support are first sequentially moved, and then simultaneously brought into contact with a supporting pallet and substrate, so as to condition, emboss, fix, form, or shape a surface of the substrate, or an image on the substrate, to thereby improve the quality thereof, or of further graphic images applied thereto.

17 Claims, 3 Drawing Sheets

MACHINE FOR FORMING IMPROVED GRAPHIC IMAGES ON SUBSTRATES

BACKGROUND OF THE INVENTION

1. Field of the Invention

This invention relates generally to image forming, and, more particularly, to a machine for simultaneously applying heat and pressure to a substrate to obtain improved results when producing graphic images thereon, by various processes.

2. Description of Related Art

Many types of materials and products may have graphic images applied thereto, utilizing various operations or processes. For example, products may have graphic images applied thereto by processes using adhesive, discharge, embossing, foil, silk-screen, sublimation, thermal transfer, or other types of operations. Such operations may involve the forming of intricate designs, utilizing a number of colors or images, some of which may be raised, requiring a high degree of precision. However, when forming graphic images on substrates, such as textiles, because of the texture of the surface, and/or the absorbency of the material, high quality images are difficult, and very expensive to obtain. For example, if a high quality image is to be formed on a textile surface, preliminary steps must be taken to treat the surface of the textile, so that the final image is of high quality. Other processes require additional steps, or expensive equipment to obtain the high quality graphic images on substrates.

Although some means are known to provide improved image results on various substrates, they tend to be difficult to use, time consuming and labor intensive. As in most businesses, since the applying, forming, fixing, etc. of images on substrates is becoming more competitive, it is becoming increasingly more important to be able to form high quality images on various substrates, using different processes, in a more efficient, inexpensive, less-time consuming manner.

Thermal or heat transfer presses are known for applying graphic images on textiles or other similar substrates, or to press foil onto a substrate. However, when used to form high definition graphic images, this process tends to be very slow, time consuming and difficult to use, and overall, too expensive. Therefore, there exists a need in the art to provide an improved and automated device for forming better resolution in graphic images, thereby providing high definition images on various substrates. For example, a device that forms a smoother surface on a substrate will provide better print resolution and a smoother feel to a printed garment.

SUMMARY OF THE INVENTION

Accordingly, it is a general object of the present invention to provide an improved system for forming graphic images. It is a more particular object of the present invention to provide an improved system for forming high resolution graphic images on a substrate. It is further particular object of the present invention to provide an improved system having a heated platen to enable high definition images to be formed, printed, or otherwise produced on a substrate. It is a still further particular object of the present invention to provide a fixed or portable system to enable high quality graphic images to be produced on a substrate. It is a further particular object of the present invention to provide a frame, including top and bottom operating means to reciprocate a heated platen and a bottom support into contact with a pallet supporting a substrate. It is yet another particular object of the present invention to provide a frame means utilizable with existing textile printing and graphic image transfer equipment which cooperates with the existing systems to prepare a substrate so that high definition graphic images may be produced on the substrate utilizing the existing systems.

In accordance with one embodiment of the present invention, there is provided a frame, including top and bottom holding platforms supporting operating means to move a top heated platen, and a bottom support into contact with a substrate holding pallet and the top heated platen, so as to provide a greater and more even pressure to a substrate, whereby a high quality graphic image may be quickly and easily produced thereon.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention, and sets forth the best modes contemplated by the inventor of carrying out his invention. Various modifications, however, will remain readily apparent to those skilled in the art, since the generic principles of the present invention have been defined herein, specifically to describe a novel and improved system having a heated platen and pressure applying means for producing improved graphic images on substrates.

Figure 1:
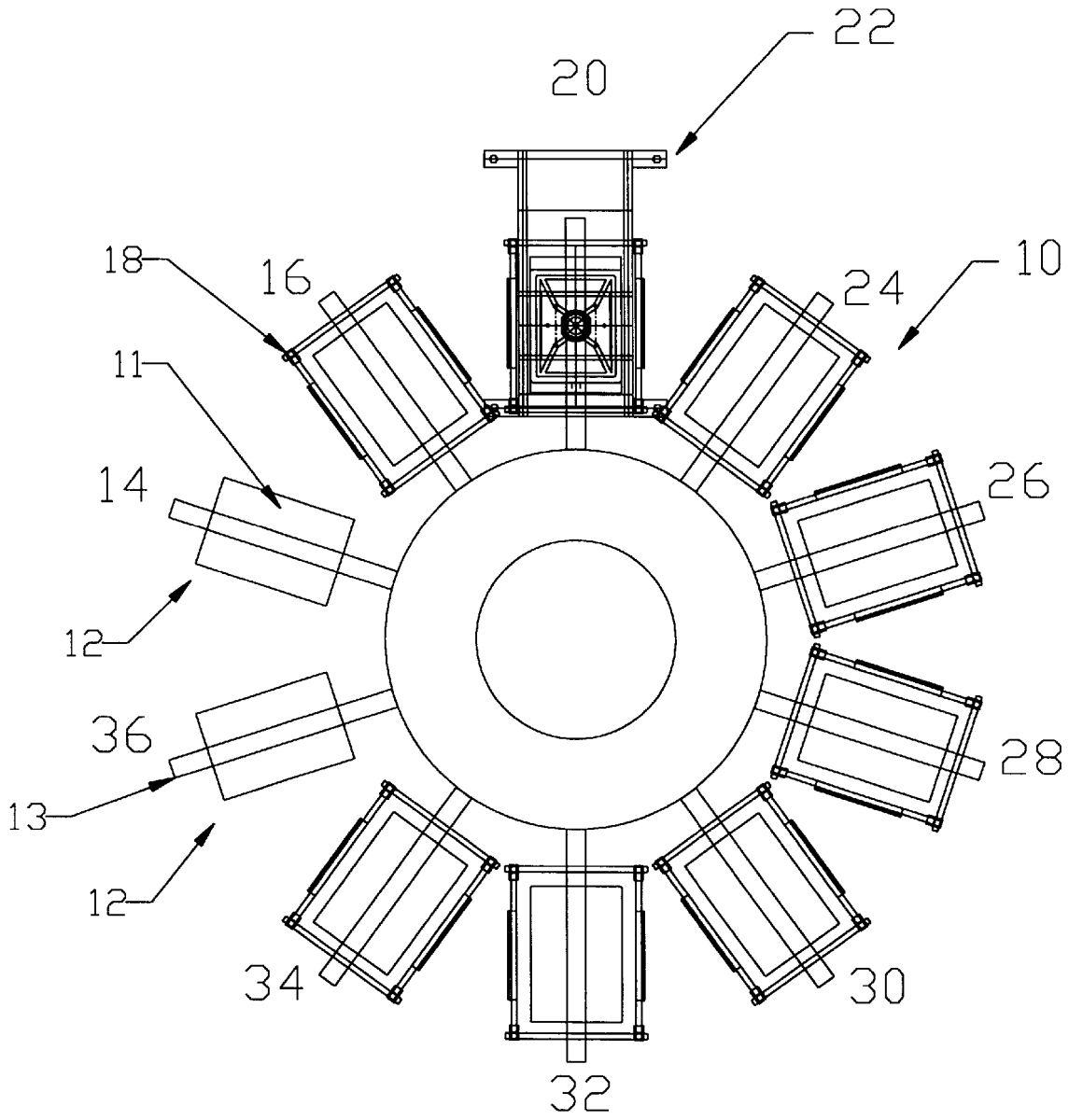
FIG. 1 is a top plan view of a printing carousel having a plurality of rotatable printing platens, with a system of the present invention, having a heated platen for forming improved graphic images on substrates, moved into position, over one of the printing platens.

It is to be understood, that the present invention is applicable to the production of improved graphic images on a substrate, such as a textile, using any known method of fixing, adhering or activating images. Examples of such methods include adhesive, discharge, embossing, flash, foil, silk-screening, sublimation, thermal and other known operations. However, for ease in understanding, the present invention will be generally described as used in connection with a carousel-type printing machine of a known type, as indicated at 10 in FIG. 1. As is known, this type of printing machine has a plurality of pallets 12 carried on pallet arms 13, which are indexed or rotated around the machine to allow a substrate 11, such as a textile, or the like, placed on the pallets to be printed by screens, or to have images produced on the substrate by other known types of systems, to apply graphic images to the substrate in multiple steps, such as by the printing of multiple colors thereon. In this type of a carousel printing machine, the substrate 11 to be printed is usually placed on the pallet 12 at a first position or station 14. The machine is then indexed, and the substrate 11 on the pallet 12 at the first position 14 is moved to a second position or station 16 under a printing screen, or other type of conditioning, embossing, forming, printing or transfer means 18. The substrate 11 then has an image applied, formed, or printed on a top surface thereof, at this second position 16. The pallet 12 and substrate 11 are then indexed or moved to a third position or station 20, where normally a second embossing, forming, printing, transfer, or other step would take place. However, in utilizing the unique process and system of the present invention, a device 22 of the present invention is built-in or moved into position over the pallet 12. The device 22 is operated to condition, form or shape the image applied on the substrate 11 at the second position 16, or to perform such operation on the substrate, so a further step may be taken. For example, if a printing operation, wet ink may be pressed into a flatter, smoother finish to allow further color inks to be printed thereon, or, the system 22 may be used to perform discharge, embossing, foil or other image forming, such as sublimation, or the like, on a surface of the substrate 11. That is, the substrate 11 may be flattened, formed, molded and/or smoothed by a heated platen under pressure, applied by the device of the present invention, as described more fully below.

After the operation on the substrate 11 is finished at the third position 20, the machine 10 is indexed again, and the pallet 12 and substrate 11 moved through one or more additional positions or stations 24–34 for completion of the graphic image, as by printing, etc. After the completed image is formed on the substrate, in the other positions or stations 24–34, the machine is indexed and the substrate 11 moved into a final position or station indicated at 36, where the finished substrate may be removed.

Turning now to FIGS. 2–5, the operation of the improved process and device 22 of the present invention will now be explained in further detail. When the pallet 12, having the substrate 11 thereon is moved into the third position 20 within the device 22 of the present invention, it is aligned with a heated platen 38, reciprocally carried in a first member 40 of a frame 42. The frame 42 may be opened or closed, and includes a plurality of first support members 44 connected to a plurality of other or second members 40, 46, 48. If the device 22 is not built-in to a machine, and is to be made movable or portable, a plurality of rollers or wheels 50 may be added to the base thereof, to allow the entire frame 42 to be easily moved from one station or machine to another, and into any desired position at a station or machine. The rollers or wheels 50 may include a lockdown feature or locking devices to enable the wheels to be secured against movement when the frame 42 has been rolled into a desired working position.

Figure 3:
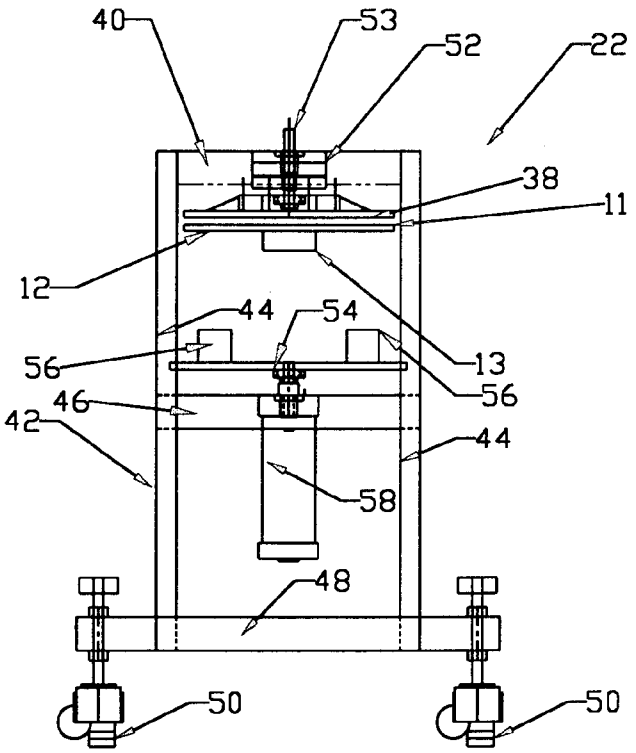
FIG. 3 is a side elevational view of FIG. 2.
Figure 2:
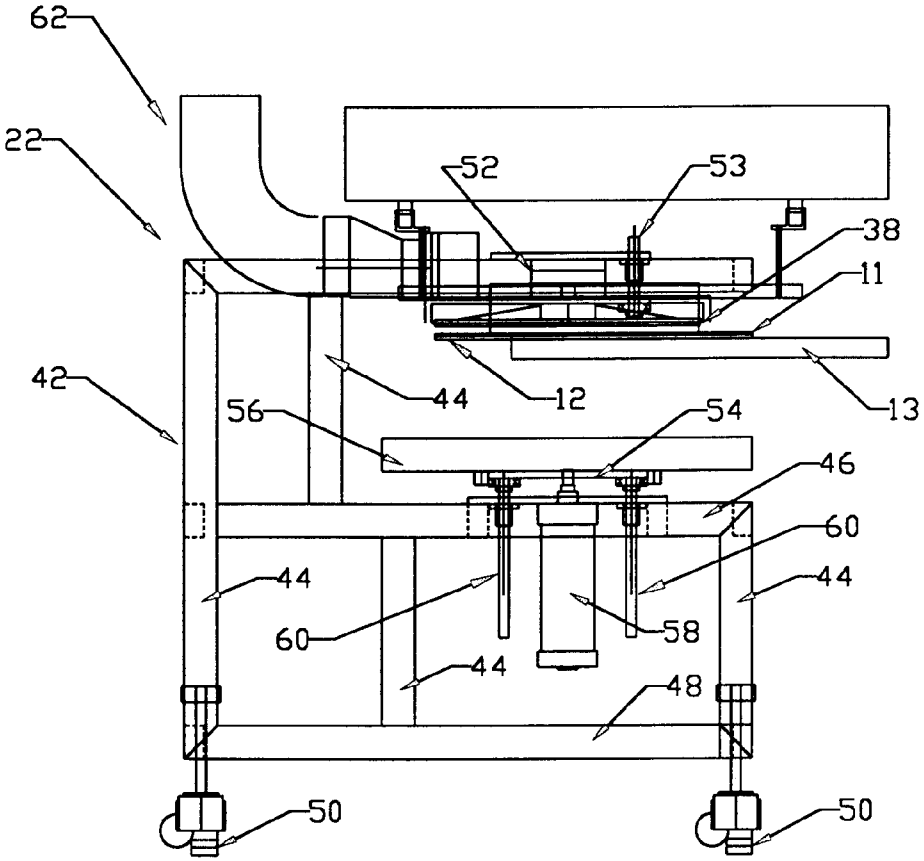
FIG. 2 is a front elevational view of the system of the present invention, in the non-active or open position.
Figure 5:
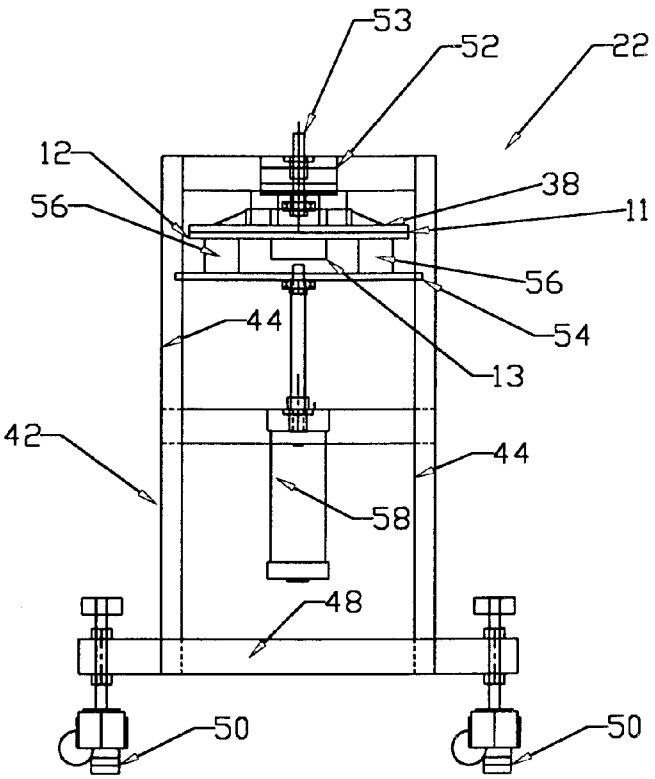
FIG. 5 is a side elevational view of FIG. 4.
Figure 4:
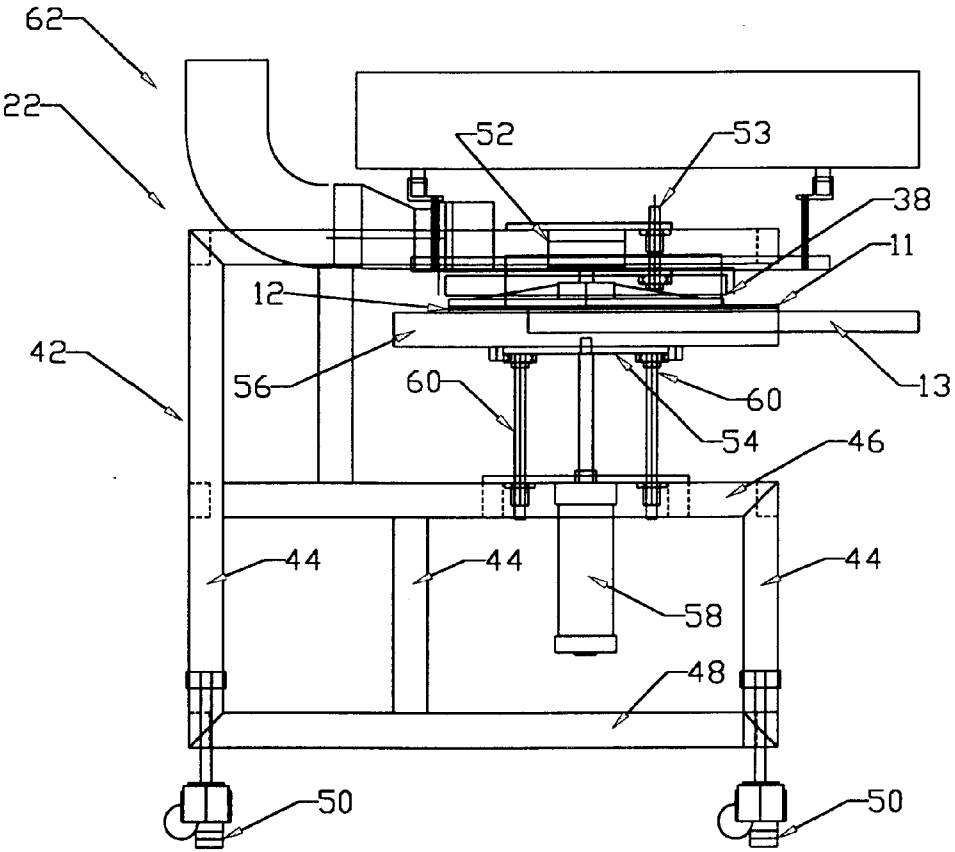
FIG. 4 is a front elevational view of the system of FIG. 2 in the actuated or closed position.

The platen 38 is heated by any available or known means, to a predetermined temperature, and is operated between the open or non-actuated position shown in FIGS. 2 and 3, and the actuated, closed, or operated position shown in FIGS. 4 and 5. In the actuated position, platen 38 is pressed into contact with the top of the pallet 12, to thereby press against the top surface of any substrate 11 held thereon. This reciprocating movement may be accomplished in any known manner, such as by use of one or more power actuated cylinders 52, having a piston, or the like, actuated by, for example, a hydraulic or pneumatic means, and may include a guide 53.

Additionally, as shown most clearly in FIGS. 2 and 3, the device 22 of the present invention includes a support 54, having a pair of elongated bars 56, adjustably carried thereon, so as to be adjustable to various pallet widths. This support 54 is reciprocally held within the member 46 and is movable between the open position shown in FIGS. 2 and 3, and the actuated or closed position shown in FIGS. 4 and 5. Actuation of the support 54 and the adjustable, elongated bars 56 is also preferably by means of one or more hydraulic or pneumatic cylinders, or a similar type power means 58. The movement of the support 54 and elongated bars 56 towards and away from the substrate 11 is coordinated with the movement of the heated platen 38, so that the heated platen 38 and elongated bars 56 are simultaneously pressed against the substrate 11 and pallet 12. This simultaneous contact is required to avoid problems with existing machines or printers, such as 10, because of the high pressures applied by the device 22 of the present invention. The support 54 may be moved by two or more pistons, or may have a pair of guide rods 60, if only one cylinder 58 is used.

In operation, as shown in FIGS. 2 and 3, the pallet 12 and any substrate 11 supported thereon in printing machine 10 is indexed or moved into an aligned position under the heated platen 38. Support 54 is first raised, a predetermined distance (for example, approximately 7 inches out of a total of about 8 inches), until a limit switch, or the like, is contacted, the heated platen 38 is then moved downwardly against the top of the top surface substrate 11, approximately 1 to 2 inches, and simultaneously therewith, the horizontal bars 56 are moved the remaining distance, until their tops contact and press against the lower surface of the pallet 12 (as shown in FIGS. 4 and 5), at the same time as the heated platen 38 presses against the top surface and substrate 11. That is, the elongated bars 56 and heated platen 38 are sequentially and then simultaneously moved. The heated platen 38 and the elongated bars 56 are then maintained in contact with the pallet 12 and the substrate 11, a predetermined amount of time, to apply sufficient heat and pressure to a printed graphics image, a thermally transferred image, or to fix a discharged ink, or to otherwise adhere, activate, emboss, or form a graphic image onto or applied to a surface of the substrate. After the heat and pressure have been applied the predetermined period of time, the heated platen 38 and the support 54 are simultaneously moved from the closed position shown in FIGS. 4 and 5, to their open or non-actuated positions, shown in FIGS. 2 and 3.

The system of the present invention may be provided with an exhaust hood 62, which extends over the heated platen 38, to take away any noxious fumes generated during the operation of the device 22.

Thus, there has been described an improved and more efficient process and system for heating and pressurizing a substrate to which a graphic image has been or is applied, thermally transferred, fixed, formed, embossed, or adhered, so as to provide a higher definition and better resolution image in a substantially more economical manner than presently available with known graphics printing or image forming devices.

Those skilled in the art will appreciate the various adaptations and modifications of the just-described preferred embodiments can be configured without departing from the scope and spirit of the invention. Therefore, it is to be understood that, within the scope of the appended claims, the invention may be practiced other than is specifically described herein.

What is claimed is:

1. A method of improving the quality of a graphic image produced on a substrate, comprising the steps of:

mounting a substrate on a pallet;

moving the pallet and substrate to a position under a heated platen;

moving the heated platen into contact with the substrate; and first sequentially moving a movable pressure-applying element and the heated platen, and then simultaneously moving the movable pressure-applying element into contact with a lower surface of the pallet and the heated platen into contact with the substrate, to apply a predetermined amount of heat and pressure to the substrate, so as to activate, adhere, condition, emboss, or fix a graphic image to the surface of the substrate.

2. A device for improving quality of a graphic image applied to a substrate in combination with another machine that previously or subsequently applies the graphic image to the substrate, comprising, in combination:

a pallet for carrying the substrate which is to be conditioned, enhanced formed or shaped by the device;

a frame;

a heated platen reciprocally mounted within the frame;

a movable pressure-applying element reciprocally mounted within the frame, below the heated platen and the pallet; and operating means for first moving the movable pressure-applying element and then moving the heated platen between open and closed positions whereby the movable pressure-applying element and the heated platen will simultaneously contact and apply heat and pressure to the substrate held on the pallet moved into a position between the movable pressure-applying element and the heated platen.

3. The device of claim 2 wherein the operating means for moving the heated platen is a power operated cylinder, the operating means for moving the movable pressure-applying element is pneumatically operated, and the movable pressure-applying element includes at least one elongated bar.

4. The device of claim 3 wherein the movable pressure-applying element is comprised of a support plate having a pair of elongated bars adjustably mounted thereon.

5. The device of claim 2 wherein the movable pressure-applying element is first moved to a position below a lower surface of the pallet; and the movable pressure-applying element and the heated platen are then sequentially moved so as to simultaneously contact the substrate on an upper surface of the pallet and the lower surface of the pallet so as to exert heat and pressure against the substrate on the upper surface of the pallet.

6. The device of claim 5, further including power operated means attached to the movable pressure-applying element and the heated platen to sequentially operate the same.

7. The device of claim 6, further including a plurality of guide rods secured to the movable pressure-applying element so as to guide the movement thereof in the frame.

8. The device of claim 6 wherein the movable pressure-applying element is comprised of at least one elongated bar.

9. The device of claim 8 wherein there are two elongated bars and the two elongated bars are adjustably carried on a movable support.

10. The device of claim 9 wherein the two elongated bars contact the lower surface of the pallet, when in the closed position.

11. A device for improving quality of a graphic image applied to a substrate in combination with another machine that previously or subsequently applies the graphic image to the substrate, comprising, in combination:

a pallet supporting the substrate which is to be conditioned, enhanced, formed, or shaped by the device;

a frame;

a plurality of support members in the frame;

a heated platen movable between open and closed positions, held in a first of the plurality of support members;

a pressure-applying member movable between open and closed positions, held within a second of the plurality of support members in the frame, below the heated platen; and operating means for sequentially moving the pressure-applying member and the heated platen between the open and closed positions whereby the heated platen and the pressure-applying member will simultaneously contact and apply heat and pressure to the substrate on the pallet held between the pressure-applying member and the heated platen.

12. The device of claim 11, further including pneumatic cylinder operators attached to the pressure-applying member and the heated platen.

13. The device of claim 12, further including at least one elongated element held in the pressure-applying member.

14. The device of claim 13 wherein there are two, spaced-apart, horizontally elongated bars adjustably mounted in the pressure-applying member.

15. The device of claim 14 wherein, in the closed position, the two spaced-apart, horizontally elongated bars are brought into contact with a lower surface of the pallet to apply pressure to the pallet and the substrate.

16. The device of claim 15 wherein, in the closed position, the heated platen is in contact with the top surface of the substrate, whereby the substrate is acted upon by the heat of the heated platen, and the pressure applied by the heated platen and the pressure-applying member, to condition, enhance, form or shape the substrate.

17. The device of claim 11, further including a plurality of rolling elements secured to a base of the frame.

* * * * *